US007665390B2

(12) United States Patent
Hoffman

(10) Patent No.: US 7,665,390 B2
(45) Date of Patent: Feb. 23, 2010

(54) HAMMER HAVING SHOCK ABSORBING HANDLE

(76) Inventor: Charles J. Hoffman, 450 El Caminito Rd., Carmel Valley, CA (US) 93924

( * ) Notice: Subject to any disclaimer, the term of this patent is extended or adjusted under 35 U.S.C. 154(b) by 0 days.

(21) Appl. No.: 12/136,807

(22) Filed: Jun. 11, 2008

(65) Prior Publication Data

US 2008/0302214 A1 Dec. 11, 2008

Related U.S. Application Data

(60) Provisional application No. 60/943,265, filed on Jun. 11, 2007.

(51) Int. Cl.
*B25D 1/12* (2006.01)
*B25G 1/01* (2006.01)
*B25G 1/10* (2006.01)

(52) U.S. Cl. ..... 81/22; 81/20; 81/489; 16/430

(58) Field of Classification Search ..... 81/20–27, 81/489; 16/430

See application file for complete search history.

(56) References Cited

U.S. PATENT DOCUMENTS

| | | | | |
|---|---|---|---|---|
| 50,262 | A | 10/1865 | Monson | |
| D27,949 | S | 12/1897 | Sommer | |
| D35,446 | S | 12/1901 | Clements | |
| 2,809,684 | A | 10/1957 | Lyon | |
| 2,940,492 | A | 6/1960 | Curry et al. | |
| D232,251 | S | 7/1974 | Speight | |
| 4,154,273 | A | 5/1979 | Pollak | |
| 4,850,079 | A | 7/1989 | Thompson | |
| 4,958,540 | A * | 9/1990 | Davis | 81/20 |
| 5,408,902 | A | 4/1995 | Burnett | |
| 5,546,832 | A * | 8/1996 | Townsend | 81/25 |
| 5,606,772 | A | 3/1997 | Ilic | |
| 5,896,607 | A | 4/1999 | Hagen | |
| 5,906,144 | A | 5/1999 | Staviski et al. | |
| 6,009,600 | A | 1/2000 | Egeland et al. | |
| D446,705 | S | 8/2001 | Stinnissen | |

(Continued)

FOREIGN PATENT DOCUMENTS

| | | | |
|---|---|---|---|
| CA | 2208951 | C | 10/2003 |

(Continued)

*Primary Examiner*—Hadi Shakeri
(74) *Attorney, Agent, or Firm*—Jacobson Holman PLLC

(57) ABSTRACT

A striking tool is disclosed that comprises a generally U-shaped or V-shaped handle constructed of a substantially resilient material and having a head fixed at one end thereof. A second end of the handle has a hand grip or gripping region adapted to be grasped by a human hand. The second end of the U-shaped or V-shaped handle includes a flange, or stop member, to inhibit the handle from slipping out of the grasping hand. The hand grip may include a lip at a lower end thereof, such that a pinky finger of the hand may be comfortably placed on either side of the lip while the hand grasps the hand grip. The resilient material construction of the handle permits a first end of the handle to flex slightly towards and away from the second end of the handle. Accordingly, during use, the striking tool provides a damped recoil and improved striking action, imparting less shock to the hand, wrist, elbow, shoulder, and other parts of the body, as compared to a conventional striking tool.

10 Claims, 9 Drawing Sheets

U.S. PATENT DOCUMENTS

| | | | | |
|---|---|---|---|---|
| 6,282,740 | B1 | 9/2001 | Sobotka | |
| 6,311,369 | B1 | 11/2001 | Ryu | |
| 6,595,087 | B2 | 7/2003 | Whalen et al. | |
| D517,887 | S | 3/2006 | Fraga | |
| D529,360 | S | 10/2006 | Wimmer | |
| 7,168,338 | B2 | 1/2007 | Hopper, Jr. et al. | |
| 7,225,544 | B2 | 6/2007 | Petzl | |
| 2004/0045411 | A1* | 3/2004 | Youngren et al. | 81/20 |
| 2007/0051206 | A1 | 3/2007 | Horton | |
| 2007/0101547 | A1 | 5/2007 | Egeland | |

FOREIGN PATENT DOCUMENTS

| | | | |
|---|---|---|---|
| GB | 2048752 | A1 | 12/1980 |

* cited by examiner

HAMMER HAVING SHOCK ABSORBING HANDLE

CROSS-REFERENCE TO RELATED APPLICATIONS

This application claims the benefit of U.S. provisional application No. 60/943,265, filed on Jun. 11, 2007, the entirety of which is hereby incorporated by reference.

BACKGROUND OF THE INVENTION

1. Field of the Invention

This invention relates generally to hand tools, and more particularly to striking tools such as hammers.

2. Description of Related Art

Hammers and other hand tools with bent handles are known in the art. For example, U.S. Pat. No. 4,154,273 and U.S. Pat. No. 4,958,540 each teach such a device, as does Canadian Patent No. 2,208,951. Such handles may potentially provide improved control of a hammer in certain situations, and may potentially provide some strain relief to the wrist. However, none of these patents discloses a striking tool including a spring-action handle that would assist in absorbing some of the impact shock imparted to the user's hand, wrist, elbow, shoulder, and other portions of the body upon striking a nail, for example, and would assist in returning the hammer to its original starting position above the nail.

Accordingly, it is an object of the present invention to provide a striking tool having a spring-action type handle that can dampen some of the impact shock experienced by a user's hand, wrist, elbow, shoulder, and other portions of the body upon striking an object.

It is also an object of the present invention to provide a striking tool that can assist in returning the tool to its original starting point above the position of a struck object through a spring force generated within its handle.

It is yet another object of the present invention to provide a striking tool having improved user ergonomics.

It is still another object of the present invention to provide a striking tool having a handle configuration facilitating increased use of the shoulder and elbow joints, back muscles and body weight in the striking motion, with reduced movement of the wrist and, accordingly, potentially reduced wrist strain.

These and other objects and features of the present invention will become apparent in view of the present specification, drawings and claims.

BRIEF SUMMARY OF THE INVENTION

A hand-held striking tool is provided. The tool comprises a head having a striking surface, and a handle affixed to the head. The handle is constructed of a substantially resilient material and has a first end proximate the head, a second end, and at least one discontinuous region positioned between the first end and the second end.

In a preferred embodiment, the at least one discontinuous region provides a spring action between the first end and the second end upon striking an object with the striking surface of the head. Moreover, in a preferred embodiment, the striking tool comprises a hammer, and the head comprises a hammer head.

The at least one discontinuous region may comprise, for example, at least one bend which, in a preferred embodiment, comprises at least one curved region. The at least one curved region may be, for example, substantially U-shaped or substantially V-shaped.

The handle may further include a grasping region. A hand grip may be disposed proximate the grasping region. In one embodiment of the invention, at least a portion of the hand grip comprises a separate component, at least a portion of which is attached to the handle. In another embodiment of the invention, at least a portion of the hand grip is integrally formed with the handle.

Moreover, the hand grip may further include at least one finger accepting indentation. The hand grip may further include at least one lip. Furthermore, the handle may further include a stop member proximate the second end.

In an embodiment of the present invention, the handle further includes a first elongated region having a first longitudinal axis and a second elongated region having a second longitudinal axis. In this embodiment, the first longitudinal axis is nonparallel to the second longitudinal axis. In particular, in this embodiment, the first longitudinal axis and the second longitudinal axis are inclined relative to each other. This angle of inclination may be, for example, an acute angle. Moreover, in one embodiment, this acute angle may be approximately seven degrees. In another embodiment, this acute angle may be approximately ten degrees.

The handle may be constructed of fiberglass, carbon fiber, fiberglass reinforced plastic, carbon fiber reinforced plastic, a synthetic fiber, Kevlar®, spring steel, tubular aluminum, tubular steel, a phenolic material, laminated wood, or a laminated synthetic material, including materials in strip form.

DETAILED DESCRIPTION OF THE INVENTION

Figure 1:
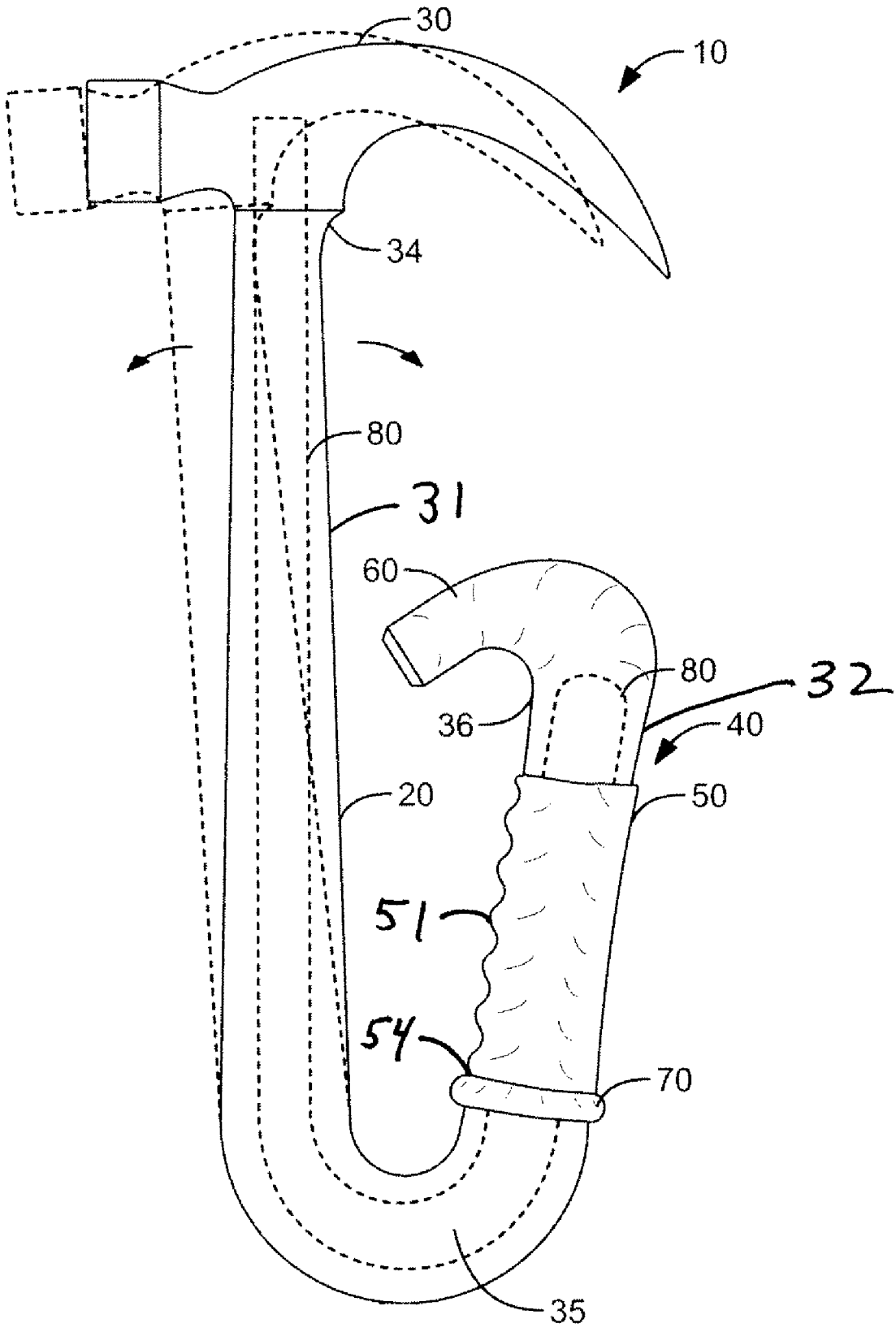
FIG. 1 is a side elevational view of a first embodiment of the present invention and showing, in particular, the relative flexing of certain regions of the handle.

While the present invention may be embodied in many different forms, there is shown in the drawings and will herein be described in detail, several specific embodiments, with the understanding that the pre disclosure can be considered as an exemplification of the principles of the present invention and is not intended to limit the present invention to the embodiments illustrated.

While several different embodiments of the present invention are described herein and shown in the various figures, common reference numerals in the figures denote similar or analogous elements or structure amongst the various embodiments.

Figure 2:
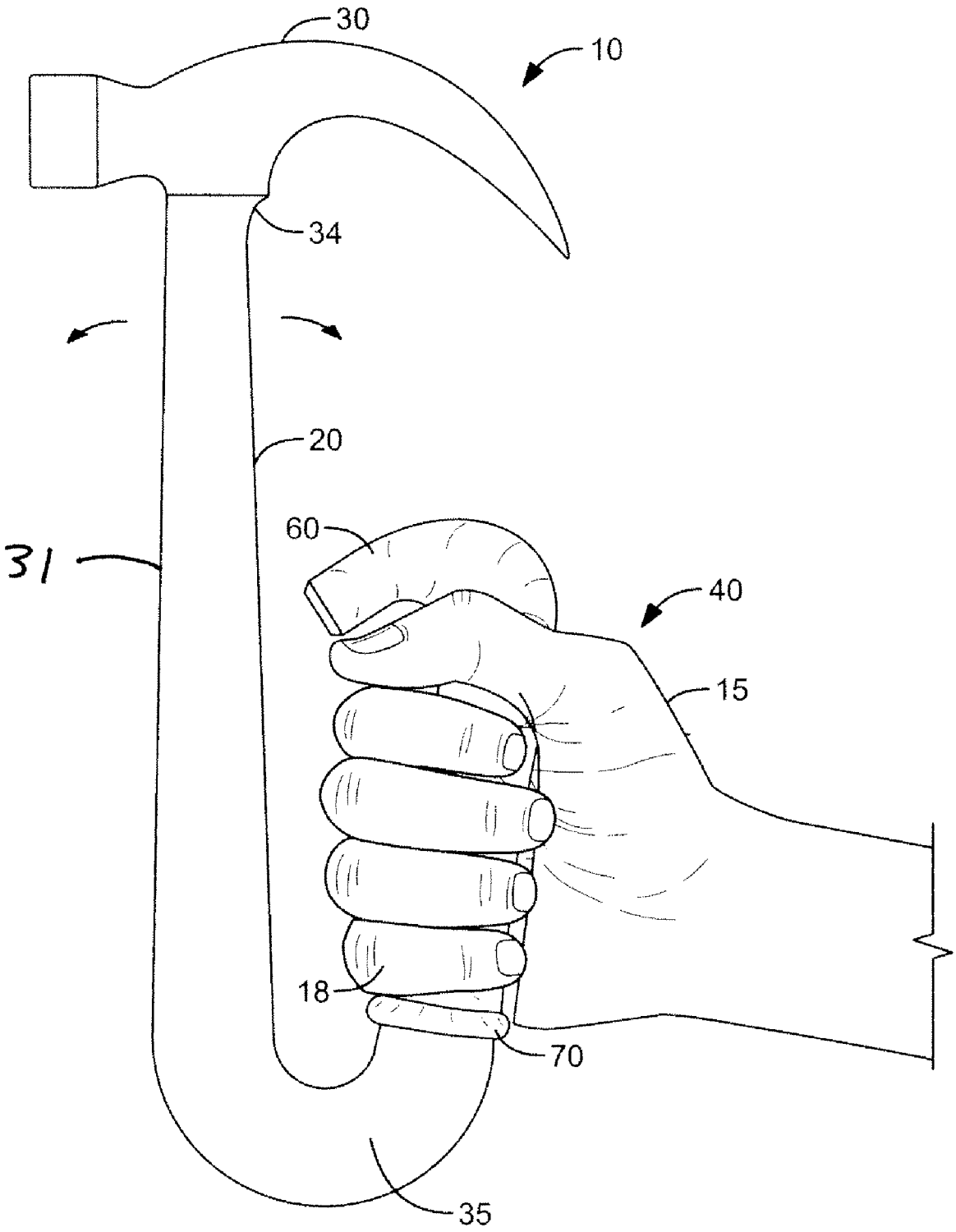
FIG. 2 is a side elevational view of the first embodiment of the present invention and, showing, in particular, a human hand gripping a portion of the handle in a first orientation.
Figure 3:
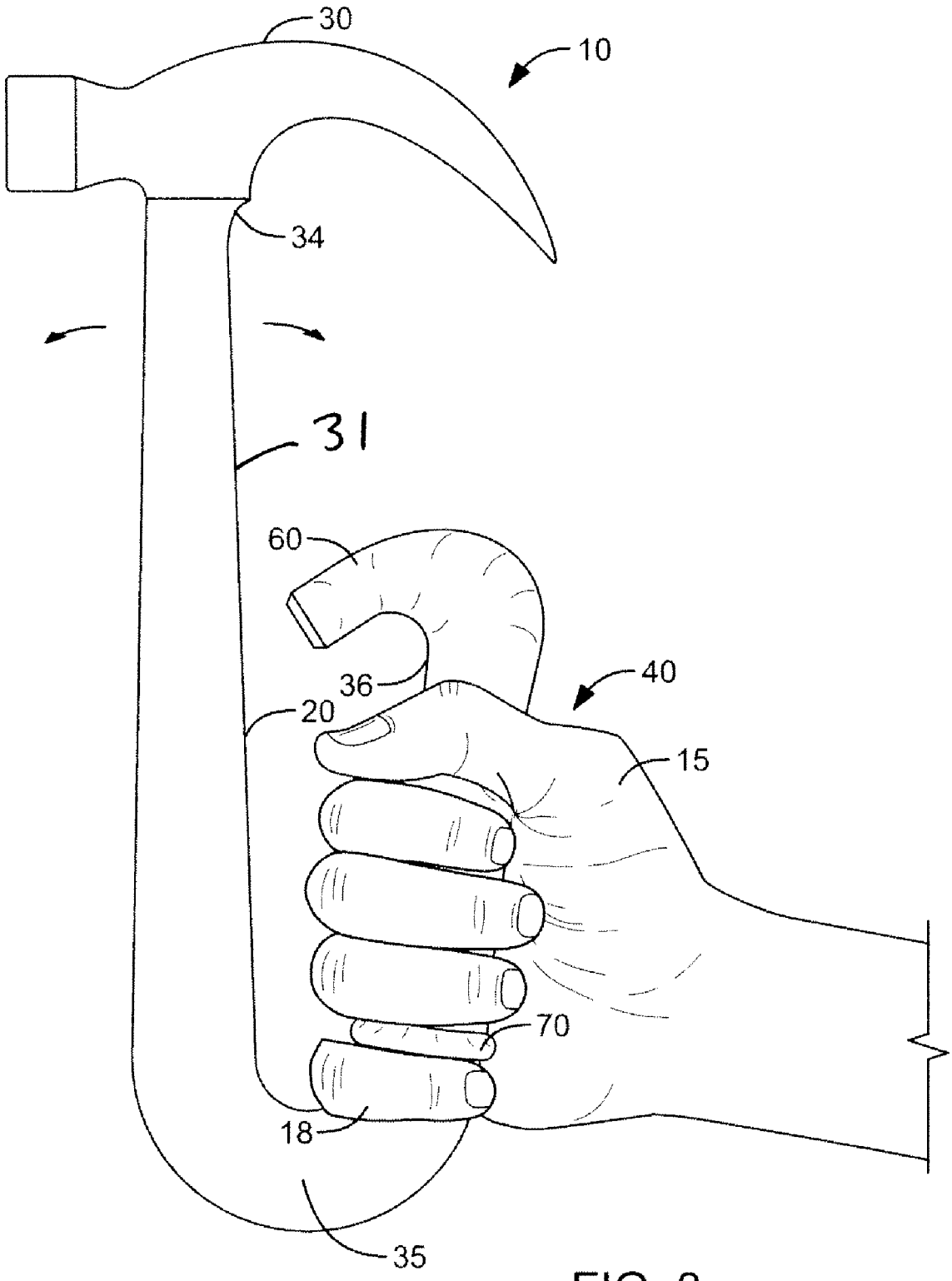
FIG. 3 is a side elevational view of the first embodiment of the present invention and, showing, in particular, a human hand gripping a portion of the handle in a second orientation.

A first embodiment of the present hammer 10 is shown in FIGS. 1-3 as comprising handle 20, having first end 34 affixed to hammer head 30. Handle 20 includes first substantially linear region 31, second substantially linear region 32, and bottom curved region 35, interposed between first linear region 31 and second linear region 32. Second linear region 32 includes gripping region 40. A hand grip 50 is disposed about a portion of linear region 32 at gripping region 40. Hand grip 50 includes finger accepting indentations 51 and lip 70 proximate lower end 54 of hand grip 50. A flange, or protrusion 60, is disposed at second end 36 of handle 20.

As shown in FIG. 1, an optional central core 80 may be disposed within handle 20. Central core 80, when present, provides additional strength and reinforcement to handle 20. Central core 80 is preferably constructed of a suitable high strength yet resilient material.

Hammer head 30 may be, for example, a conventional claw hammer head, having a striking end and a claw end. Moreover, hammer heads of alternative shape and construction, such as, for example, engineer's hammer heads, drilling hammer heads, framing hammer heads, geologist's hammer heads, upholstery hammer heads, cross-peen hammer heads, ball-peen hammer heads, sledgehammer heads, mallet heads, and the heads of other striking tools, such as hand axes and hatchets, are likewise contemplated by the present invention.

Gripping region 40 and hand grip 50, including finger accepting indentations 51, facilitate the grasping of hammer 10 by a human hand 15, as shown in FIGS. 2 and 3. Lip 70 of hand grip 50 permits pinkie finger 18 of hand 15 to be comfortably placed either above lip 70, as shown in FIG. 2, or below lip 70, as shown in FIG. 3, as hand 15 grasps hand grip 50 and, in turn, gripping region 40 of substantially linear region 32 of handle 20. Accordingly, a user can grasp hammer 10 with either type of grip, as desired for comfort and control. Hand grip 50 may be constructed, for example, of an elastomeric rubber or rubberized material, a foam material, an over-molded plastic material, or other comfortable material providing a secure grasping surface. Alternatively, hand grip 50 may be integrally formed with handle 20, and may include integrally formed finger accepting indentations 51 and/or knurling, or other integrally formed grip-enhancing raised areas and indentations, proximate gripping region 40.

Protrusion 60 may optionally be included to serve as a stop member, to inhibit any inadvertent slippage of handle 20 out of the user's grasping hand. Protrusion 60 may alternately be incorporated into the hand grip 50, such as in the form of an enlarged lip or flange proximate the upper end of hand grip 50, or may be releasably attachable to, rather than integrally formed with, handle 20.

Handle 20 is preferably constructed of a substantially resilient material, permitting first end 34 of the handle 20 to flex slightly towards and away from second end 36, facilitated by the flexing of handle 20, specifically, proximate bottom curved region 35. In FIG. 1, hammer head 30 and first linear region 31 of handle 20 are shown in solid lines to depict handle 20 being flexed, in its partially compressed configuration. Hammer head 30 and first linear region 31 of handle 20 are shown in phantom lines in FIG. 1 to depict handle 20 in its uncompressed configuration.

Handle 20 may be constructed, for example, of one or more of a variety of resilient materials, including composite fiberglass, carbon fiber, fiberglass reinforced plastic, carbon fiber reinforced plastic, synthetic fibers such as Kevlar®, other fiber or fiber-reinforced materials, spring steel, tubular aluminum, steel, or other elemental metal or alloy in tubular form, a phenolic material, laminated wood, a laminated synthetic material, or other such suitably strong yet resilient materials or combinations thereof, including materials in strip form. For example, a plurality of layers of woven fiberglass, in combination with chopped fiberglass, may be bound together with an epoxy resin, and cured under pressure, with vacuum used to extract any air bubbles during manufacture of the handle. A gelcoat material may optionally be applied to handle 20 to provide a quality surface finish. Moreover, for fiberglass embodiments of handle 20, specialized methods of fiberglass manufacture, such as a sheet molding compound, a resin transfer molding technique, or a variant of a Pultrusion or other continuous composite material manufacturing technique, may alternatively be employed.

Due to the use of resilient materials, and the nonstandard shape and configuration of the handles of the various embodiments of the present invention, during use, hammer 10 has an improved, spring-like striking and recoil action, imparting less shock to the hand 15, wrist, elbow, shoulder, and other portions of the body than conventional hammers and aiding in the return of the hammer to an original upraised position. Hammer 10 is accordingly easier to use than a conventional hammer since the spring-action of handle 20 helps push the hammer back above a nail that is being driven into wood, for example.

Figure 4:
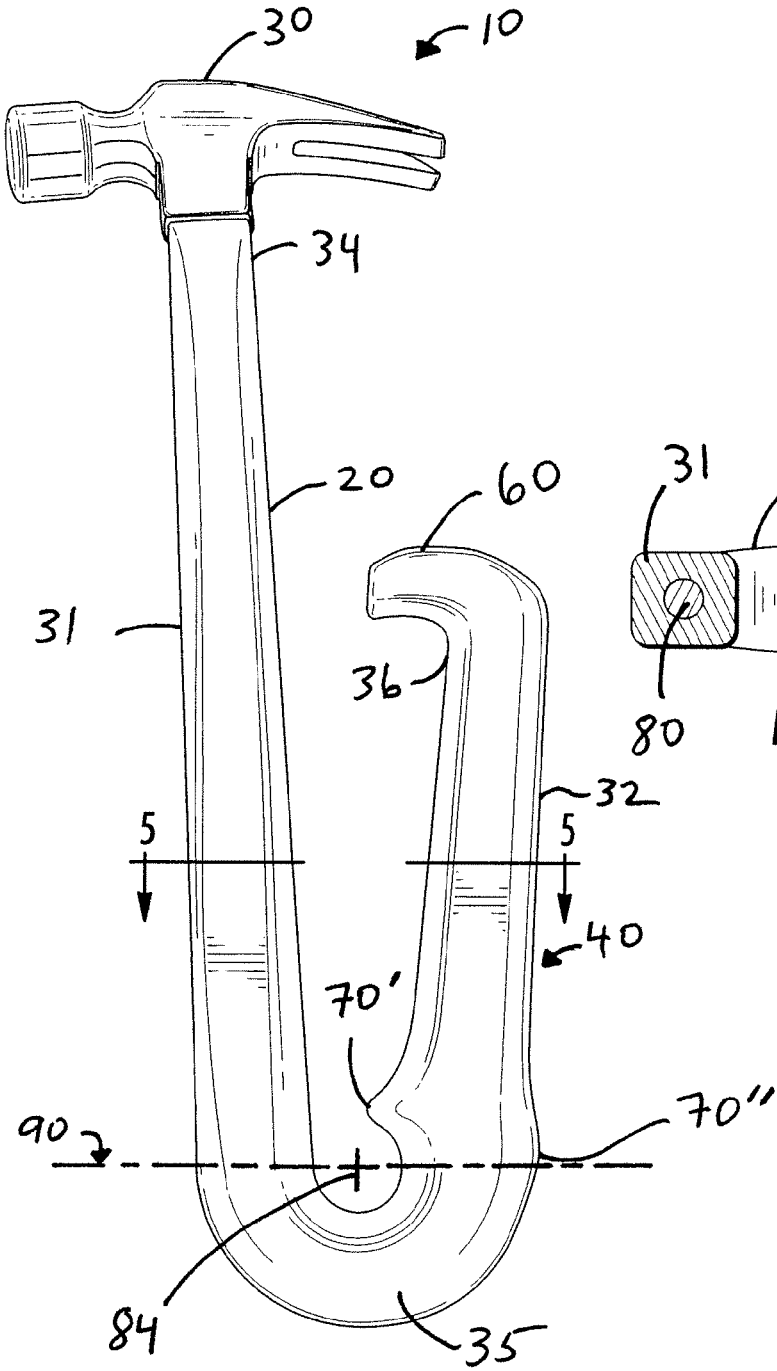
FIG. 4 is a perspective view of a second embodiment of the present invention.
Figure 5:
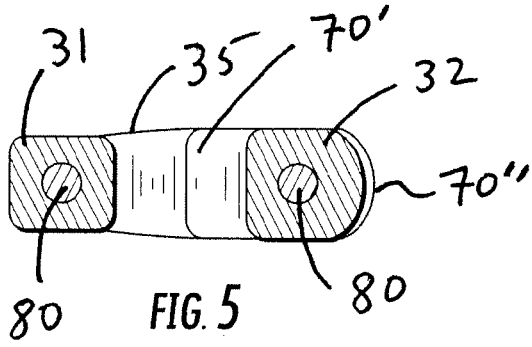
FIG. 5 is a sectional view of the second embodiment of the present invention, taken generally along line 5-5 of FIG. 4 and looking in the direction of the arrows.

Moreover, in this embodiment of the invention, and as shown in FIGS. 1-3, the longitudinal axes of first linear region 31 and second linear region 32 of handle 20 are not substantially aligned. Rather, they are inclined away from each other at an acute angle of, for example, approximately seven degrees. Bottom curved region 35 accordingly describes an arc of approximately one hundred seventy-three degrees (i.e., one hundred eighty degrees less the relative inclination of seven degrees). In another embodiment of the present invention, this acute angle is approximately ten degrees, and bottom curved region 35 accordingly describes an arc of approximately one hundred seventy degrees, This relative inclination, in combination with the distal spacing of first linear region 31 and second linear region 32, results in improved ergonomics of use for many users. In particular, this configuration tends to require relatively less wrist flexion when striking a nail or other target with hammer 10, as compared with conventional hammers. Rather, increased use is made of the elbow and shoulder joints, as well as the back muscles and other parts of the body, as hammer 10 is swung in a striking motion. As the shoulder and elbow tend to be stronger and more powerful joints than the wrist, many users may experience an improved and more naturally feeling swinging motion of hammer 10, as compared with conventional hammers. Moreover, the increased distance from hammer head 30 created by the offset of second linear region 32 results in a longer lever arm and an increased moment at the hammer head, providing a smoother, pendulum-like swing with an increased striking force. Other angles, or a parallel relationship between first linear region 31 and second linear region 32, may alternatively be employed. When a parallel relationship is employed, the distal spacing between first linear region 31 and second linear region 32 still provides significant ergonomic improvement, relative to conventional hammers, including reduced wrist flexion A second embodiment of the present hammer 10 is shown in FIGS. 4-5. In this embodiment, first linear region 31 and second linear region 32 are again inclined away from each other at a relative acute angle of approximately seven degrees or, in an alternative embodiment, approximately ten degrees. Moreover, in this embodiment, hand grip 50 is eliminated, with the user grasping the handle surface directly at gripping region 40 of handle 20. The function of lip 70 of grip means 50 of FIGS. 1-3 is instead provided by integrally formed protrusions 70' and 70" on opposing sides of second linear region 32, proximate its juncture with bottom curved region 35 of handle 20. Of course, a separate hand grip, such as a hand grip rubber or rubberized material that may be substantially flush with surrounding regions of the handle, may alternatively be used. As best seen in FIG. 4, while both protrusion 70' and 70" have a curved apex, protrusion 70', disposed inwardly towards first linear region 31 of handle 20, is significantly larger in size than protrusion 70", disposed outwardly, away from first linear region 31. As best seen in FIG. 5, in this embodiment, central core 80 may be, for example, cylindrical in shape and circular in cross section or, as will be described supra, may have other configurations, such as elliptical or stadium in cross-section.

In this second embodiment of the present invention, bottom curved region 35 has an inner radius of approximately 0.500 inches, and an outer radius of curvature of approximately 1.750 inches, relative to center of curvature 84. First linear region 31 has a length of approximately 12.000 inches, extending from transverse line 90 intersecting center of curvature 84, to the lower surface of hammer head 30. Additional length of first linear region 31 extends within an aperture of hammer head 30 and facilitates the securing hammer head 30 and handle 20 together. Second linear region 32 has a length of approximately 7.500 inches, extending from transverse line 90 to an apex of protrusion, or stop member 60. Handle 20 has a maximum width along its overall length of approximately 1.125 inches.

Figure 6:
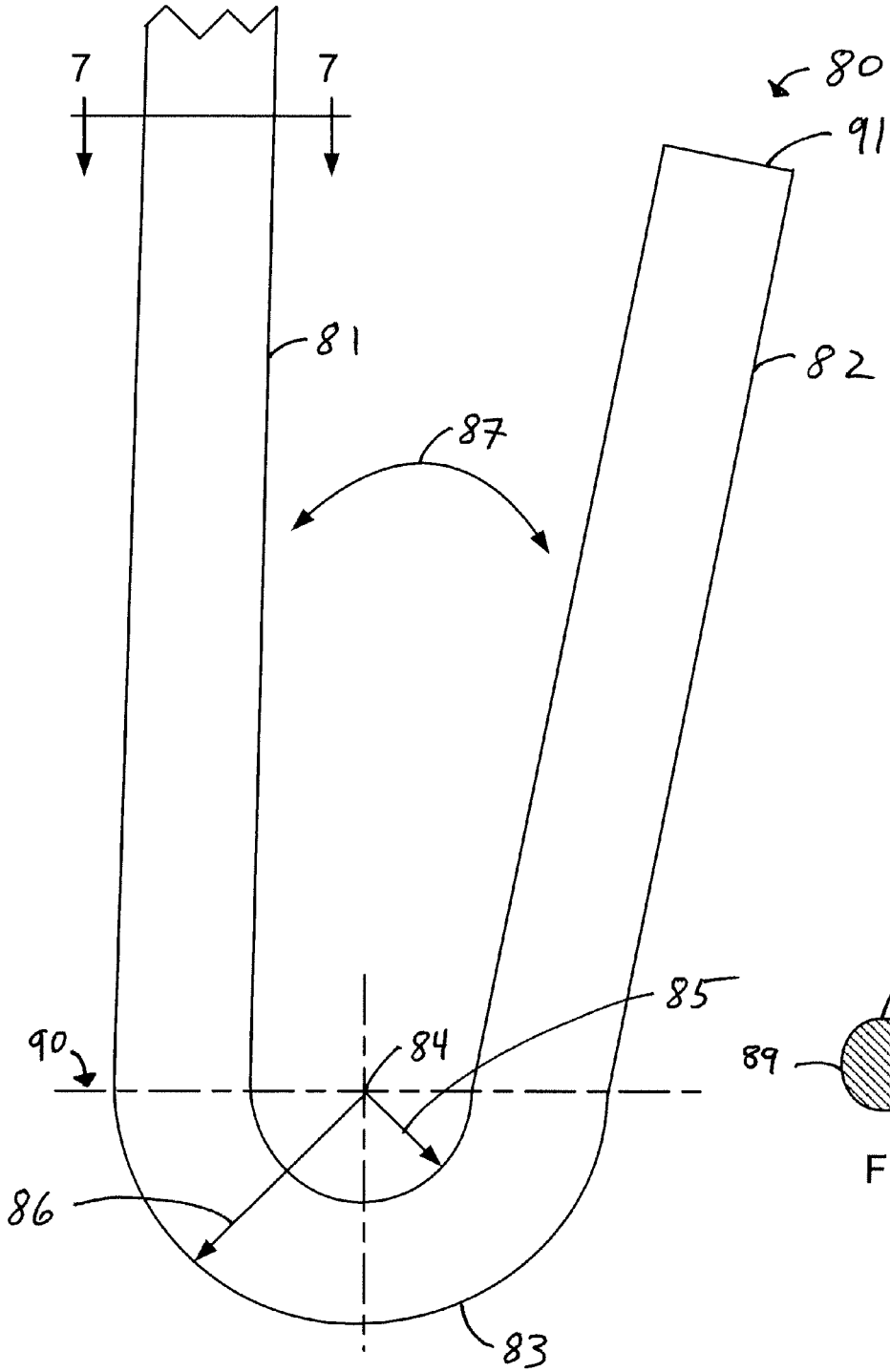
FIG. 6 is a side elevational view of one embodiment of the central core.
Figure 7:
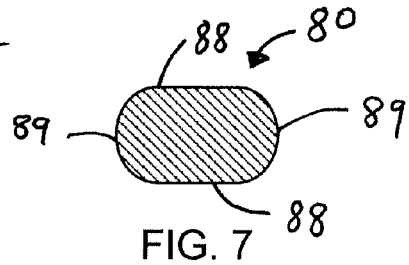
FIG. 7 is a sectional view of the embodiment of the sectional core of FIG. 6, taken generally along line 7-7 of FIG. 6 and looking in the direction of the arrows.

An alternative construction of central core 80 is shown in FIGS. 6-7 as comprising first substantially linear region 81, second substantially linear region 82, and bottom curved region 83, interposed between first linear region 81 and second linear region 82. In one embodiment of the present invention, bottom curved region 83 has an inner radius 85 of approximately 0.750 inches, and an outer radius 86 of approximately 1.650 inches, relative to center of curvature 84. First linear region 81 has a length of approximately 13.750 inches, extending from transverse line 90 intersecting center of curvature 84, to an opposing endpoint (not shown). Second linear region 82 has a length of approximately 6.400 inches, extending from transverse line 90 to opposing endpoint 91. Moreover, in this embodiment, the longitudinal axes of first linear region 81 and second linear region 82 of central core 80 are not substantially aligned. Rather, they are inclined away from each other at an acute angle 87. In one embodiment of the present invention, angle 87 is approximately seven degrees. In another embodiment of the invention, angle 87 is approximately ten degrees. Other angles, or a parallel relationship between first linear region 81 and second linear region 82 may alternatively be used, as dictated by the desired angle of the first and second linear regions of the handle in which central core 80 is to be embedded.

As shown in FIG. 7, in this embodiment, central core 80 has a cross-section that is substantially stadium shaped, rather than the circular cross-section of the embodiment of FIGS. 4-5. In particular, central core 80, in cross-section, includes two opposing linear sides 88, joined by opposing curved ends 89. Central core 80 has a cross-sectional length of approximately 0.900 inches and a cross sectional width of approximately 0.500 inches. Moreover, opposing linear sides 88 each have a radius of curvature of approximately 0.250 inches.

Figure 8:
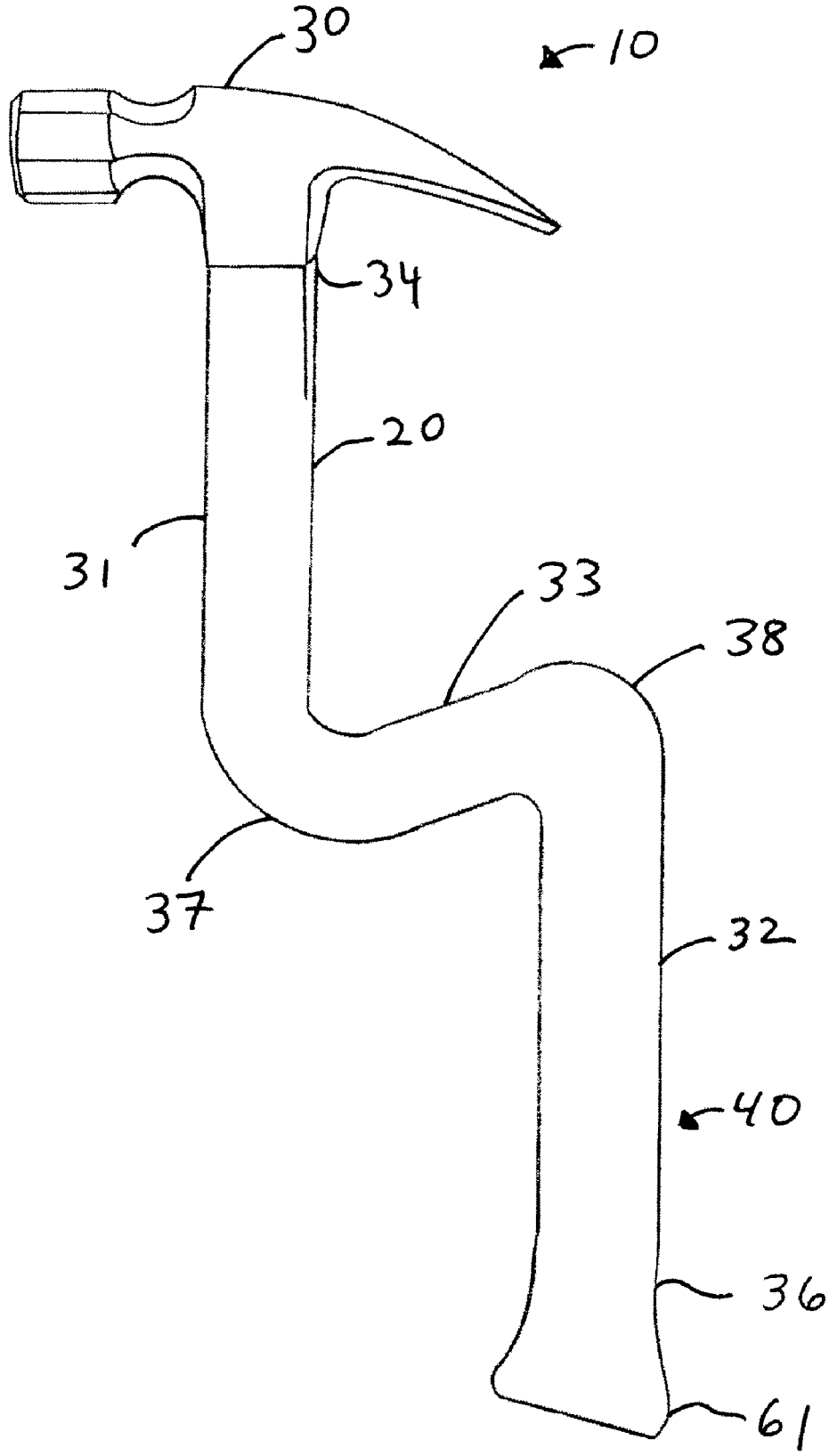
FIG. 8 is a side elevational view of a third embodiment of the present invention.

Another alternative embodiment of hammer 10 is shown in FIG. 8. In this embodiment, first curved region 37, third substantially linear region 33, and second curved region 38 are interposed between first substantially linear region 31 and second substantially linear region 32. Moreover, in this embodiment, second linear portion 32 extends further below first linear portion 31, relative to hammer head 30, rather than extending back vertically towards hammer head 30. Furthermore, in this embodiment, the longitudinal axes of first linear region 31 and second linear region 32 are substantially parallel to each other. In addition, in this embodiment, second end 36 of handle 20 terminates in a flared region 61, inhibiting handle 20 from slipping out of the user's hand while in use. As in the previously discussed embodiments, handle 20 is constructed of a resilient material which, in combination with the nonlinear hammer configuration and offset between first linear region 31 and second linear region 32, enable the handle to both perform a shock absorbing function and to provide improved user ergonomics.

Figure 9:
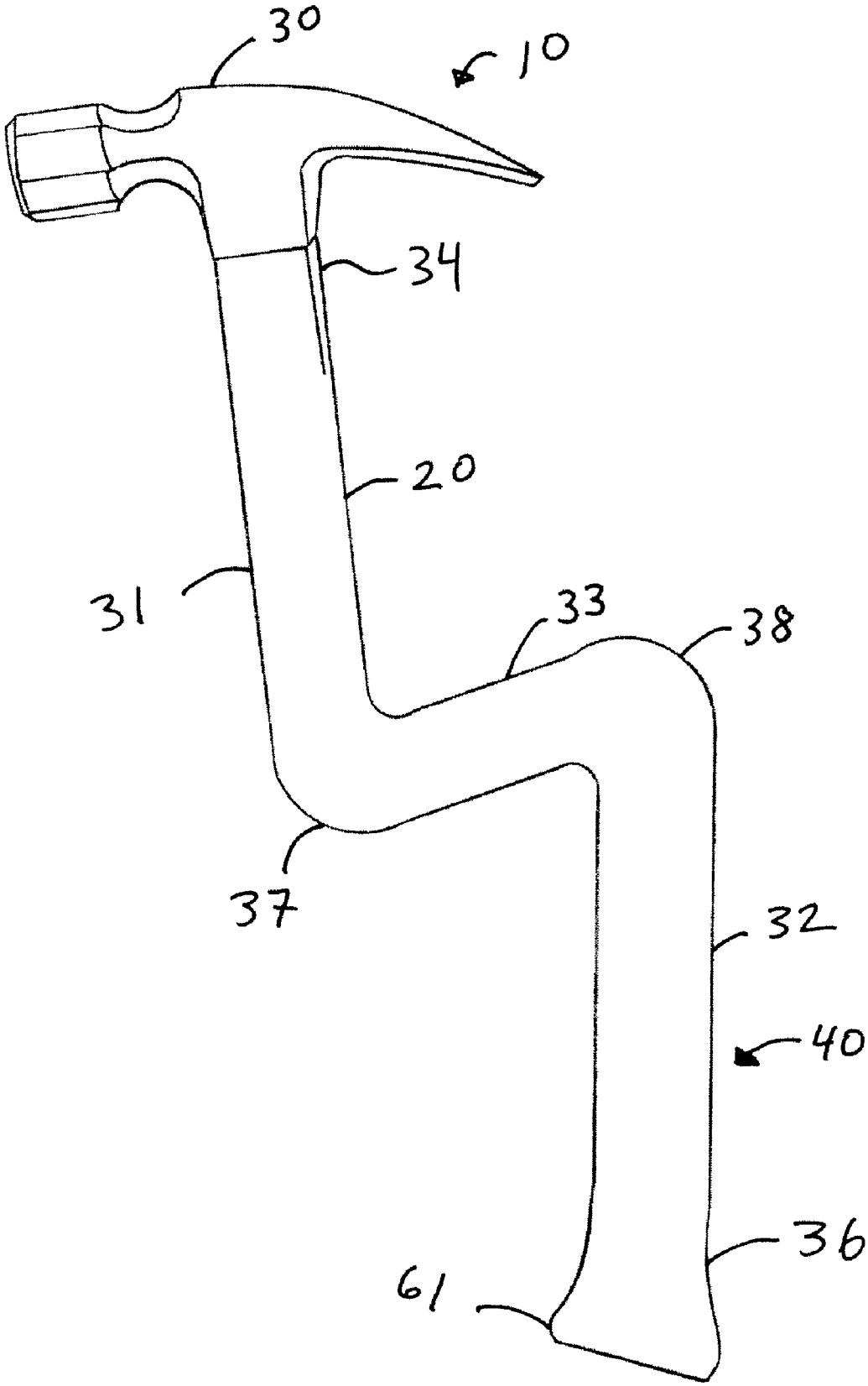
FIG. 9 is a side elevational view of a fourth embodiment of the present invention.

Yet another alternative embodiment of hammer 10 is shown in FIG. 9. This embodiment is similar in overall configuration to the embodiment of FIG. 8, with the exception that at least one of first curved region 37 and second curved region 38 have a different angle of curvature, resulting in the longitudinal axes of first linear portion 31 and second linear portion 32 being nonparallel to each other. In particular, from the perspective of a user grasping handle 20 proximate gripping region 40, first linear region 31 angles and extends away from the user. As in the previously discussed embodiments, handle 10 is constructed of a resilient material which, in combination with the nonlinear hammer configuration and offset between first linear region 31 and second linear region 32, enable the handle to both perform a shock absorbing function and to provide improved user ergonomics.

Figure 10:
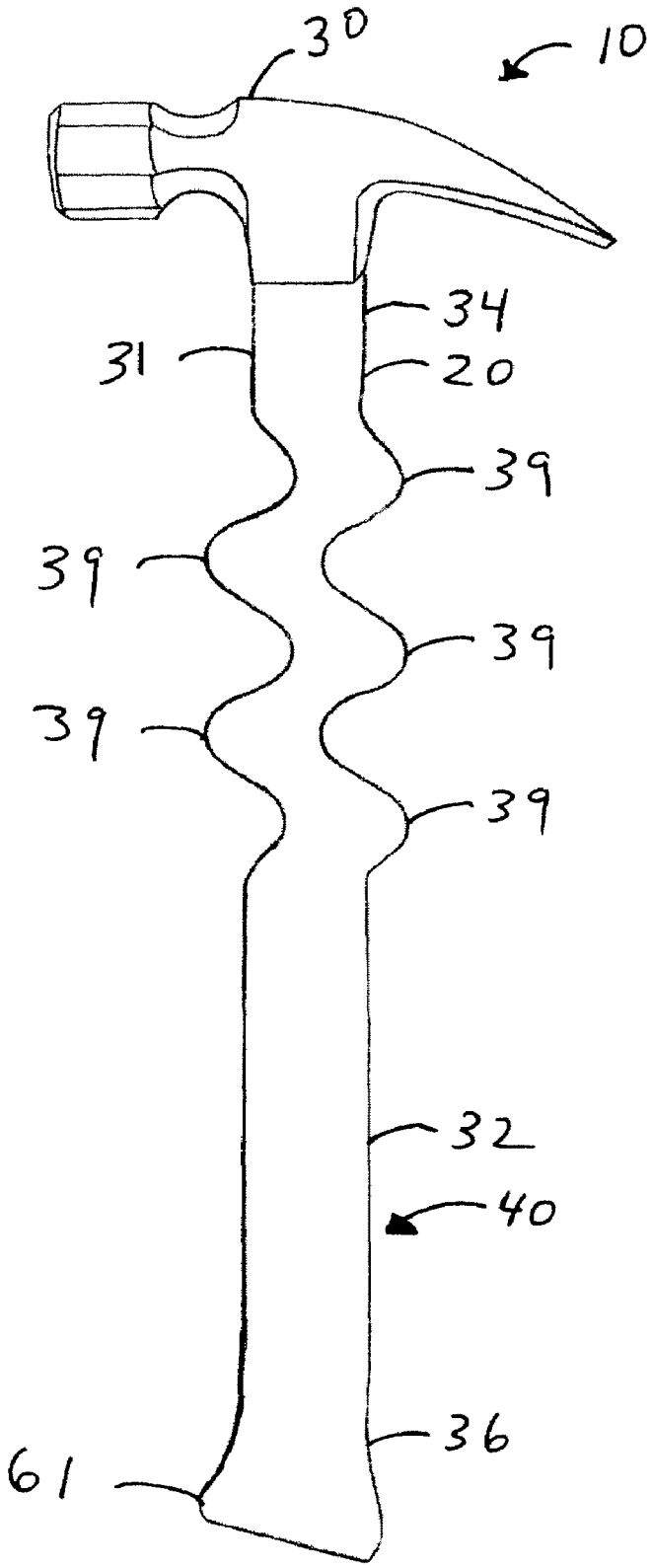
FIG. 10 is a side elevational view of a fifth embodiment of the present invention.

Still another embodiment of hammer 10 is shown in FIG. 10. In this embodiment, first linear portion 31 and second linear portion 32 have longitudinal axes that are substantially collinear. Moreover, in this embodiment, a plurality of opposing curved regions 39 are interposed between first linear portion 31 and second linear portion 32. As in the previously discussed embodiments, handle 10 is constructed of a resilient material which, in combination with the wave-like or oscillating configuration created by curved regions 39, enables the handle to perform a spring-like, shock absorbing function. Although five curved regions 39 are shown in FIG. 10, fewer or additional curved regions may alternatively be employed.

Figure 11:
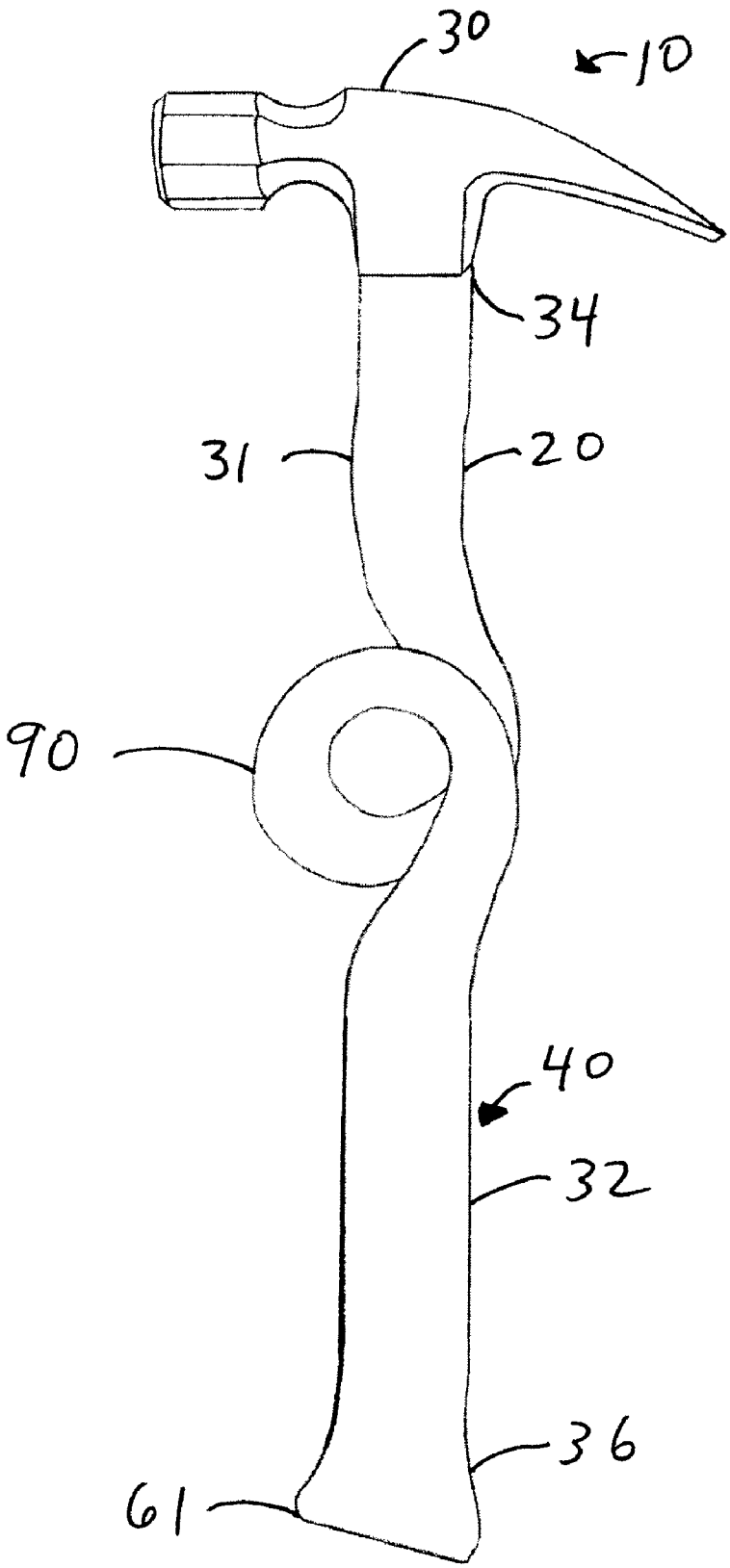
FIG. 11 is a side elevational view of a sixth embodiment of the present invention.

A further embodiment of hammer 10 is shown in FIG. 11. In this embodiment, first linear portion 31 and second linear portion 32 have longitudinal axes that are substantially collinear. Moreover, in this embodiment, a coiled or looped region 90 is interposed between first linear portion 31 and second linear portion 32. As in the previously discussed embodiments, handle 10 is constructed of a resilient material which in combination with the coil-like configuration created by looped region 39, enables the handle to perform a spring-like, shock absorbing function. Although a single looped region 39 is shown in FIG. 11, a plurality of such looped regions may alternatively be employed.

The foregoing description and drawings are merely to explain and illustrate the invention, and the invention is not limited thereto except insofar as the following claims are so limited, as those skilled in the art with the present disclosure before them will be able to make modifications and variations therein without departing from the scope of the invention.

What is claimed is:

1. A hand-held striking tool comprising:

a head having a striking surface; and a handle coupled to the head, the handle being constructed of a substantially resilient material and having a first end proximate the head, a free second end, and at least one discontinuous region positioned between the first end and the free second end, the at least one discontinuous region providing a spring action upon striking an object with the striking surface of the head, said at least one discontinuous region being divided into two elongated non-parallel regions separated by a curved region, wherein the curved region is substantially U-shaped, said two elongated regions extending at an acute angle with respect to each other, one of the two elongated regions having a central longitudinal axis centrally extending along the one elongated region terminating in the head, the other of the two elongated regions terminating in the free second end, the free second end being located between the first end and the curved region relative to said central longitudinal axis while being spaced from the one elongated region, the striking surface of the head being on one side of the central longitudinal axis and the other of the two elongated regions being on an opposite side of the central longitudinal axis, the other elongated region defining a hand grip portion of the handle within a grasping region.

2. The invention according to claim 1, wherein the striking tool comprises a hammer, and the head comprises a hammer head.

3. The invention according to claim 1, wherein at least a portion of the hand grip comprises a separate component, at least a portion of which is attached to the handle.

4. The invention according to claim 1, wherein at least a portion of the hand grip is integrally formed with the handle.

5. The invention according to claim 1, wherein the hand grip includes at least one finger accepting indentation.

6. The invention according to claim 1, wherein the hand grip includes at least one lip.

7. The invention according to claim 1, wherein the handle further includes a stop member proximate the second end.

8. The invention according to claim 1, wherein the acute angle is an angle of approximately seven degrees.

9. The invention according to claim 1, wherein the acute angle is an angle of approximately ten degrees.

10. The invention according to claim 1, wherein the handle is constructed of at least one material selected from the group comprising fiberglass, carbon fiber, fiberglass reinforced plastic, carbon fiber reinforced plastic, a synthetic fiber, spring steel, tubular aluminum, tubular steel, a phenolic material, laminated wood, or a laminated synthetic material.

* * * * *